US010858211B2

(12) United States Patent
Song et al.

(10) Patent No.: US 10,858,211 B2
(45) Date of Patent: Dec. 8, 2020

(54) DOUBLE-CHANNEL PAPER FEEDING MECHANISM AND SHEET MEDIUM PROCESSING DEVICE

(71) Applicant: Shandong New Beiyang Information Technology Co., Ltd., Shandong (CN)

(72) Inventors: Zhenhua Song, Shandong (CN); Zhengmin Zhang, Shandong (CN); Ning Feng, Shandong (CN); Xiaochun Li, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 193 days.

(21) Appl. No.: 16/081,823

(22) PCT Filed: Mar. 3, 2017

(86) PCT No.: PCT/CN2017/075591

§ 371 (c)(1),
(2) Date: Aug. 31, 2018

(87) PCT Pub. No.: WO2017/148435

PCT Pub. Date: Sep. 8, 2017

(65) Prior Publication Data

US 2019/0062094 A1 Feb. 28, 2019

(30) Foreign Application Priority Data

Mar. 3, 2016 (CN) ..... 2016 1 0119702

(51) Int. Cl.
*B65H 20/02* (2006.01)
*B65H 23/038* (2006.01)
*B65H 23/26* (2006.01)

(52) U.S. Cl.
CPC ..... *B65H 20/02* (2013.01); *B65H 23/038* (2013.01); *B65H 23/26* (2013.01);
(Continued)

(58) Field of Classification Search
CPC ..... B65H 20/02
(Continued)

(56) References Cited

U.S. PATENT DOCUMENTS

2001/0005466 A1* 6/2001 Nishimura ..... B41J 13/0072 400/578
2006/0103068 A1* 5/2006 Sekiya ..... B65H 5/062 271/264

(Continued)

FOREIGN PATENT DOCUMENTS

CN 101653743 A 2/2010
CN 201707694 U 1/2011

(Continued)

OTHER PUBLICATIONS

International Search Report dated May 4, 2017, in the Inernational Application No. PCT/CN2017/075591, 3 pages.

*Primary Examiner* — Anthony H Nguyen
(74) *Attorney, Agent, or Firm* — Wilmer Cutler Pickering Hale and Dorr LLP

(57) ABSTRACT

Provided is a double-channel paper feeding mechanism and a sheet medium processing device. The double-channel paper feeding mechanism includes a fixed frame, a movable frame and a connection mechanism. The fixed frame is provided with a first channel plate and a second channel plate. A first portion of the first channel plate and a first portion of the second channel plate form a conveying channel. An opening for inserting the movable frame is formed between second portions of the two channel plates. The movable frame is provided with a third channel plate and a fourth channel plate. When the movable frame is mounted on the fixed frame, the second portion of the first channel plate and the third channel plate are arranged oppositely and form a first input channel in connection with the conveying channel, the second portion of the second
(Continued)

channel plate and the fourth channel plate form a second input channel in connection with the conveying channel.

18 Claims, 4 Drawing Sheets

(52) U.S. Cl.
CPC .... *B65H 2402/441* (2013.01); *B65H 2407/20* (2013.01); *B65H 2701/1133* (2013.01); *B65H 2701/174* (2013.01); *B65H 2801/21* (2013.01)

(58) Field of Classification Search
USPC ..... 101/228
See application file for complete search history.

(56) References Cited

U.S. PATENT DOCUMENTS

2008/0006166 A1* 1/2008 Ohkubo ..... G03G 21/1633 101/479
2009/0166966 A1* 7/2009 Nishikata ..... B65H 5/36 271/272
2010/0098473 A1* 4/2010 Hosoi ..... G03G 21/1642 399/400
2014/0219699 A1* 8/2014 Ishikawa ..... B41J 15/16 400/618
2015/0231899 A1* 8/2015 Yamamoto ..... B41J 11/00 347/220
2017/0115617 A1* 4/2017 Yamaguchi ..... B65H 5/26

FOREIGN PATENT DOCUMENTS

CN 201729536 U 2/2011
CN 203959440 U 11/2014
JP H09136735 A 5/1997
JP 2003098767 A 4/2003
JP 2010202329 A 9/2010

* cited by examiner

--Prior Art--

DOUBLE-CHANNEL PAPER FEEDING MECHANISM AND SHEET MEDIUM PROCESSING DEVICE

CROSS REFERENCE TO RELATED APPLICATIONS

This application is a U.S. National Stage entry of PCT International Application No. PCT/CN2017/075591 filed on Mar. 3, 2017, which claims priority to Chinese Patent Application No. 201610119702.0 filed on Mar. 3, 2016, the contents of which are incorporated herein by reference in their entirety.

TECHNICAL FIELD

The present disclosure relates to the field of sheet medium treatment, and for example, relates to a double-channel paper feeding mechanism, as well as a sheet medium processing device that uses the double-channel paper feeding mechanism.

BACKGROUND

A sheet medium processing device includes one or more of a paper cutting mechanism, a printing mechanism, a scanning mechanism and a magnetic reading-writing mechanism, and is configured to perform corresponding processing on a sheet medium (hereinafter referred to as the medium or paper). In order to avoid frequent replacement of the medium, a sheet medium processing device having a double-channel paper feeding mechanism is provided in the related art. As shown in FIG. 1, the sheet medium processing device includes a channel mechanism and a paper supply mechanism. The channel mechanism includes a first input channel 11', a second input channel 12' and a conveying channel 13'. The first input channel 11' includes a first channel plate 111' and a second channel plate 112' which are arranged in parallel at an interval and are connected through a fastener (not shown). The second input channel 12' includes a third channel plate 121' and a fourth channel plate 122' which are arranged in parallel at an interval and are connected through a fastener (not shown). The first input channel 11' and the second input channel 12' converge at an entrance of the conveying channel 13'. The paper supply mechanism includes a first paper supply mechanism 21' and a second paper supply mechanism 22' which are respectively arranged at the entrances of the first input channel 11' and the second input channel 12' to supply medium to the sheet medium processing device.

When the sheet medium processing device works, the first paper supply mechanism 21' is selected as required to supply paper to the conveying channel 13' through the first input channel 11', or the second paper supply mechanism 22' is selected as required to supply paper to the conveying channel 13' through the second input channel 12', so as to perform treatment such as cutting, printing, and magnetic reading and writing.

As to the sheet medium processing device since the first input channel 11' and the second input channel 12' are formed by the channel plates which are arranged in parallel at an interval and which are fixedly connected through the fastener, when paper jamming occurs in one input channel, it is required to integrally remove the channel plates of the input channel, resulting in time and labor consumption and inconvenience in maintenance.

SUMMARY

The present disclosure provides a double-channel paper feeding mechanism and a sheet medium processing device that uses the double-channel paper feeding mechanism, facilitating the maintenance.

For an aspect, a double-channel paper feeding mechanism is provided, including a fixed frame, a movable frame and a connection mechanism. The fixed frame is provided with a first channel plate and a second channel plate. A first portion of the first channel plate and a first portion of the second channel plate are arranged oppositely and form a conveying channel. An opening for inserting the movable frame is formed between a second portion of the first channel plate and a second portion of the second channel plate. The movable frame is detachably connected with the fixed frame through the connection mechanisms. The movable frame is provided with a third channel plate and a fourth channel plate.

When the movable frame is mounted on the fixed frame, the second portion of the first channel plate and the third channel plate are arranged oppositely and form a first input channel in connection with the conveying channel, the second portion of the second channel plate and the fourth channel plate are arranged oppositely and form a second input channel in connection with the conveying channel.

In one or more embodiments, the connection mechanism includes a first locating component and a locking component. The movable frame is inserted with the fixed frame through the first locating component. The movable frame is clamped and locked with the fixed frame through the locking component to fix a position of the movable frame relative to the fixed frame.

In one or more embodiments, the sheet medium processing device includes two connection mechanisms. The two connection mechanisms are located on both sides of the fixed frame and the movable frame along a width direction of the conveying channel.

In one or more embodiments, the first locating component includes a first inserting groove and a first inserting portion. The first inserting groove is formed in one of the fixed frame and the movable frame. The first inserting portion is arranged on the other one of the fixed frame and the movable frame. The first inserting groove has an opening. The first inserting groove is capable of being in inserting fit with the first inserting portion.

In one or more embodiments, the locking component includes a clamping groove, a clamping portion, a limiting hole and a first elastic element. The clamping groove is formed in one of the fixed frame and the movable frame. The clamping portion, the limiting hole and the first elastic element are arranged on the other one of the fixed frame and the movable frame. The clamping groove has an opening. The clamping portion is inserted with the limiting hole and is capable of being clamped with or separated from the clamping groove. A first end of the first elastic element is connected with the clamping portion, and a second end of the first elastic element is fixed to the frame in which the first elastic element is arranged. The first elastic element always has a tendency of pulling the clamping portion towards a direction opposite to an opening direction of the clamping groove.

In one or more embodiments, the limiting hole is a U-shaped hole. The U-shaped hole includes a first end and a second end. Under the action of the first elastic element, the clamping portion is capable of being stably maintained at the first end or the second end of the U-shaped hole. In a case where the movable frame is mounted on the fixed frame, the clamping portion and the clamping groove are in a clamped state when the clamping portion is located in the first end, and the clamping portion and the clamping groove are in a separate state when the clamping portion is located in the second end.

In one or more embodiments, the first locating component includes a first inserting groove and a first inserting portion. The first inserting groove is formed in one of the fixed frame and the movable frame. The first inserting portion is arranged on the other one of the fixed frame and the movable frame. The first inserting groove has an opening. The first inserting groove is capable of being in inserting fit with the first inserting portion. The first inserting groove and the clamping groove are arranged at an interval, the opening direction of the first inserting groove and the opening direction of the clamping groove form an included angle.

In one or more embodiments, the opening direction of the first inserting groove is perpendicular to the opening direction of the clamping groove.

In one or more embodiments, the locking component includes a rotation shaft, a locking hook and a pin shaft. The rotation shaft is pivoted with one of the fixed frame and the movable frame. The locking hook is fixedly connected to the rotation shaft. The pin shaft is fixedly arranged on the other one of the fixed frame and the movable frame. The locking hook is selectively clamped with the pin shaft.

In one or more embodiments, the double-channel paper feeding mechanism further includes a second locating component. The second locating component includes a second inserting groove and a second inserting portion which are selectively in inserting fit with each other. The second inserting groove is formed in one of the fixed frame and the movable frame, and the second inserting portion is arranged on the other one of the fixed frame and the movable frame. When the movable frame is mounted on the fixed frame, the second inserting portion is inserted into the second inserting groove.

In one or more embodiments, the double-channel paper feeding mechanism further includes a paper limiting mechanism. The limiting mechanism arranged in at least one of the first input channel and the second input channel and is configured to limit a position of medium in the at least one of the first input channel and the second input channel. The paper limiting mechanism includes at least one paper limiting plate. The paper limiting plate is capable of moving along the width direction of the input channel.

In one or more embodiments, the paper limiting mechanism includes two paper limiting plates. The two paper limiting plates are respectively arranged on both sides of the width direction of the input channel in which the two paper limiting plates are arranged.

In one or more embodiments, a buffer mechanism is further arranged at an inlet of at least one of the first input channel and the second input channel.

For another aspect, a sheet medium processing device is further provided, including any one of the above-mentioned double-channel paper feeding mechanism.

In the double-channel paper feeding mechanism provided by the present disclosure, the second portions of the two channel plates on the fixed frame form the opening for inserting the movable frame. When the movable frame is inserted into the opening, the movable frame is arranged opposite to the channel plates on the fixed frame, thereby forming two input channels. When paper jamming occurs in the input channels, it only needs to relieve the connection of the connection mechanism to draw the movable frame out of the opening to open the two input channels completely, thereby conveniently eliminating the jammed paper. Therefore, the double-channel paper feeding mechanism provided by the present disclosure has the advantages of simple structure and convenient maintenance.

BRIEF DESCRIPTION OF DRAWINGS

In FIG. 1:

11': first input channel; 111': first channel plate; 112': second channel plate; 12': second input channel; 121': third channel plate; 122': fourth channel plate; 13': conveying channel; 21': first paper supply mechanism; 22': second paper supply mechanism.

In FIG. 2 to FIG. 8:

1: fixed frame; 11: first channel plate; 111: first portion of first channel plate; 112: second portion of first channel plate; 12: second channel plate; 121: first portion of second channel plate; 122: second portion of second channel plate; 13: first side plate; 14: opening;

2: movable frame; 21: third channel plate; 22: fourth channel plate; 23: second side plate;

3: connection mechanism; 31: first locating component; 311: first inserting groove; 312: first inserting portion; 32: locking component; 321: clamping groove; 322: clamping portion; 323: limiting hole; 324: first elastic element; 325: rotation shaft; 326: locking hook; 327: pin shaft; 33: second locating component; 331: second inserting groove; 332: second inserting portion;

4: conveying mechanism; 41: first roller wheel component; 411: first roller wheel; 412: second roller wheel; 42: second roller wheel component; 421: third roller wheel; 422: fourth roller wheel;

5: paper limiting mechanism; 51: paper limiting plate; 52; threaded rod; 53: rotating wheel;

6: buffer mechanism; 61: buffer roller; 62: second elastic element;

7: conveying channel; 8: first input channel; and 9: second input channel.

Figure 9:
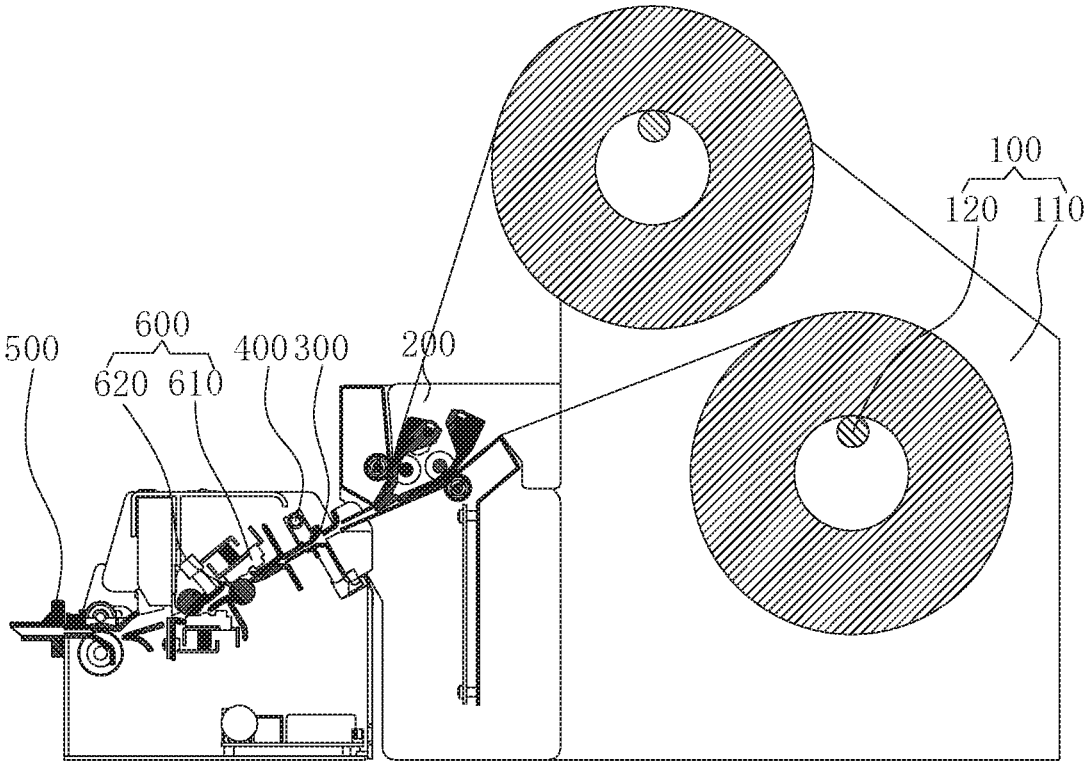
FIG. 9 is a sectional view of a sheet medium processing device using a double-channel paper feeding mechanism provided by the present embodiment.

In FIG. 9:

100: paper supply mechanism; 110: bracket; 120: rotation shaft; 200: double-channel paper feeding mechanism; 300:

medium conveying channel; 400: paper cutting mechanism; 500: paper outlet; 600: printing mechanism; 610: printing head; and 620: roller wheel.

DETAILED DESCRIPTION

Figure 1:
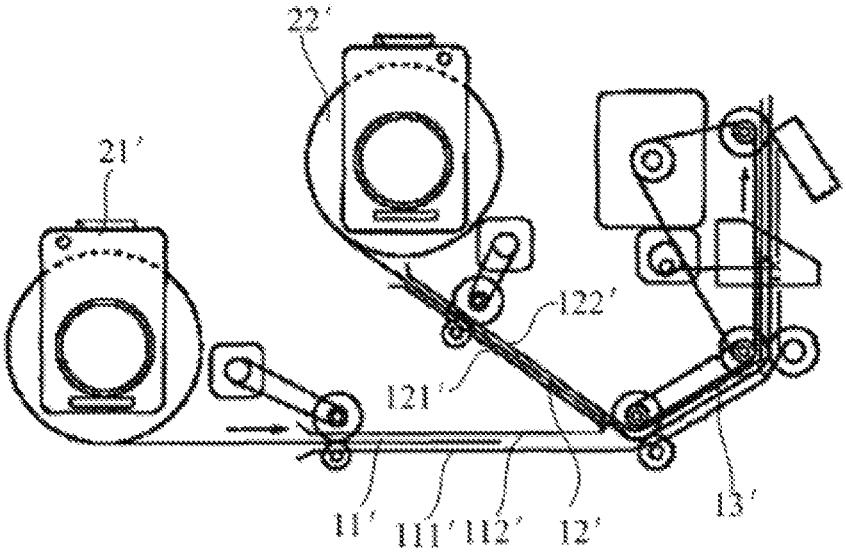
FIG. 1 is a structural schematic view of a sheet medium processing device having a double-channel paper feeding mechanism in the related art.
Figure 2:
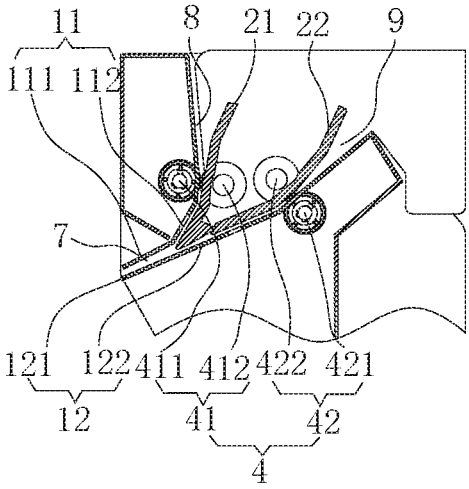
FIG. 2 is a sectional view of a double-channel paper feeding mechanism provided by a first embodiment.
Figure 3:
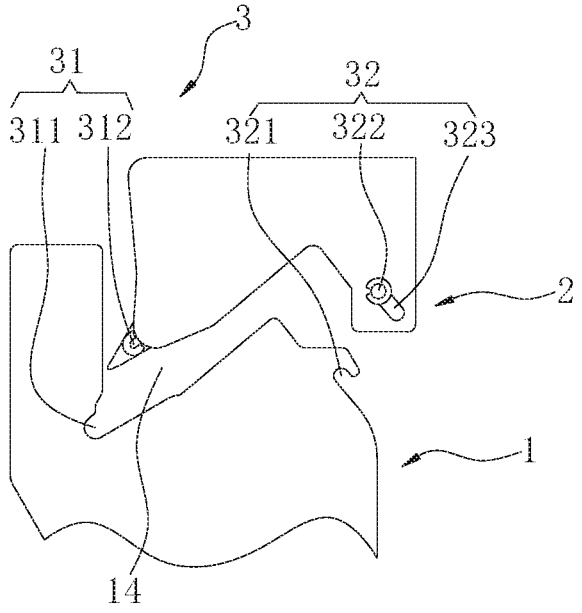
FIG. 3 is a structural schematic view of a double-channel paper feeding mechanism provided by the first embodiment in which a movable frame and a fixed frame are separated.
Figure 4:
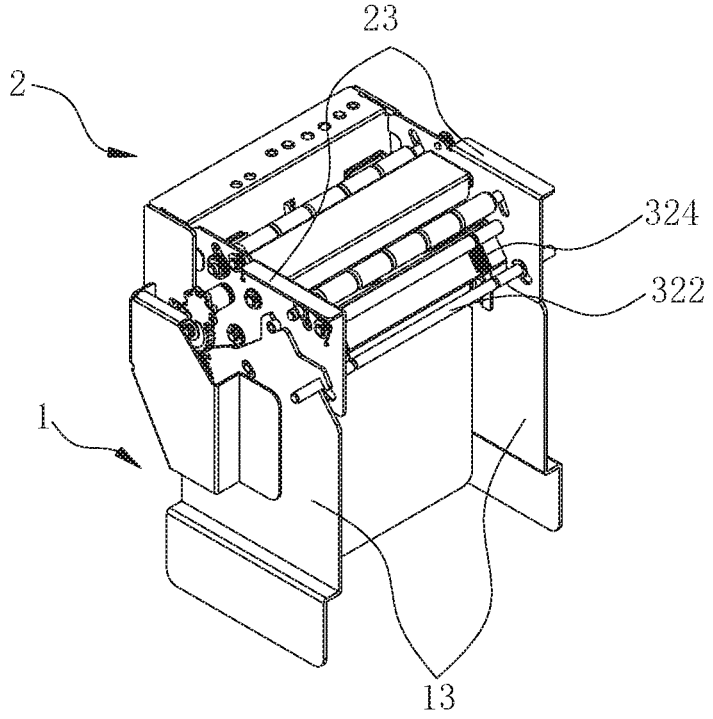
FIG. 4 is an axonometric view of a double-channel paper feeding mechanism provided by the first embodiment in which the movable frame is mounted on the fixed frame.

FIG. 2 is a sectional view of a double-channel paper feeding mechanism provided by a first embodiment. FIG. 3 is a structural schematic view of the double-channel paper feeding mechanism provided by the first embodiment in which a movable frame and a fixed frame are separated. FIG. 4 is an axonometric view of the double-channel paper feeding mechanism provided by the first embodiment in which the movable frame is mounted on the fixed frame. As shown in FIG. 2, FIG. 3 and FIG. 4, the double-channel paper feeding mechanism includes a fixed frame 1, a movable frame 2 and a connection mechanism 3. A first channel plate 11 and a second channel plate 12 are arranged on the fixed frame 1. A first portion 111 of the first channel plate 11 and a first portion 121 of the second channel plate 12 are arranged oppositely and form a conveying channel 7. An opening 14 for inserting the movable frame 2 is formed between a second portion 112 of the first channel plate 11 and a second portion 122 of the second channel plate 12. The movable frame 2 is detachably connected with the fixed frame 1 through the connection mechanism 3. The movable frame 2 is provided with a third channel plate 21 and a fourth channel plate 22. When the movable frame 2 is mounted on the fixed frame 1, the second portion 112 of the first channel plate 11 and the third channel plate 21 are arranged oppositely and form a first input channel 8 in connection with the conveying channel 7, and the second portion 122 of the second channel plate 12 and the fourth channel plate 22 are arranged oppositely and form a second input channel 9 in connection with the conveying channel 7. When the movable frame 2 is separated from the fixed frame 1, the first input channel 8 and the second input channel 9 are completely opened.

In one or more embodiments, referring to FIG. 4, the fixed frame 1 further includes two first side plates 13. The two first side plates 13 are arranged in parallel at an interval. The distance between the two side plates is adapted to a maximum width of medium. The first channel plate 11 and the second channel plate 12 are perpendicularly connected between the two first side plates 13. The movable frame 2 further includes two second side plates 23. The two second side plates 23 are arranged in parallel at an interval. The distance between outer surfaces of the two second side plates 23 is adapted to a distance between inner surfaces of the two first side plates 13. The third channel plate 21 and the fourth channel plate 22 are perpendicularly connected between the two second side plates 23. The third channel plate 21 and the fourth channel plate 22 form an included angle. The shape and size of the included angle are adapted to the shape and size of the opening 14.

The double-channel paper feeding mechanism includes two connection mechanisms 3. The two connection mechanisms 3 are located on both sides of the fixed frame 1 and the movable frame 2 along a width direction of the conveying channel. One connection mechanism is taken as an example below for description.

Referring to FIG. 3, the connection mechanism 3 includes a first locating component 31 and a locking component 32. The movable frame 2 is inserted with the fixed frame 1 through the first locating component 31. The movable frame 2 is clamped and locked with the fixed frame 1 through the locking component 32 to fix the position of the movable frame 2 relative to the fixed frame 1.

The first locating component 31 includes a first inserting groove 311 and a first inserting portion 312. The first inserting groove 311 is formed in one of the fixed frame 1 and the movable frame 2. The first inserting portion 312 is arranged on the other one of the fixed frame 1 and the movable frame 2. The first inserting groove 311 has an opening. The shape and size of the opening are matched with the shape and size of the first inserting portion 312. The first inserting groove 311 may be inserted with or separated from the first inserting portion 312.

The locking component 32 includes a clamping groove 321, a clamping portion 322, a limiting hole 323 and a first elastic element 324 (referring to FIG. 4). The clamping groove 321 is formed in one of the fixed frame 1 and the movable frame 2. The clamping portion 322, the limiting hole 323 and the first elastic element 324 are arranged on the other one of the fixed frame 1 and the movable frame 2. The clamping groove 321 has an opening. The shape and size of the opening are matched with the shape and size of the clamping portion 322. The clamping portion 322 may be clamped with or separated from the clamping groove 321. The clamping portion 322 is inserted into the limiting hole 323, and may move along the limiting hole 323. The first end of the first elastic element 324 is connected with the clamping portion 322, and the second end of the first elastic element 324 is connected with the frame in which the first elastic element 324 is arranged. The first elastic element 324 always has a tendency of pulling the clamping portion 322 towards a direction opposite to an opening direction of the clamping groove 321. In one or more embodiments, the clamping portion 322 is a shaft. When the movable frame 2 is mounted on the fixed frame 1, the clamping portion 322 is inserted with the clamping groove 321, so as to lock the movable frame 2 onto the fixed frame 1.

In the present embodiment, the first inserting groove 311 and the clamping groove 321 are formed in the first side plates 13 of the fixed frame 1 at an interval, and the opening directions of the first inserting groove 311 and the clamping groove 321 form an included angle. In one or more embodiments, the opening directions of the first inserting groove 311 and the clamping groove 321 are perpendicular. Correspondingly, the first inserting portion 312, the clamping portion 322, the limiting hole 323 and the first elastic element 324 are arranged on the second side plate 23 of the movable frame 2.

The opening direction of the first inserting groove 311 is consistent with or opposite to the opening direction of the opening 14. When the first inserting groove 311 is formed in the fixed frame 1, the opening direction of the first inserting groove 311 is consistent with the opening direction of the opening 14. When the first inserting groove 311 is formed in the movable frame 2, the opening direction of the first inserting groove 311 is opposite to the opening direction of the opening 14. In the present embodiment, the first inserting groove 311 is formed in the fixed frame 1, and the opening direction of the first inserting groove 311 is consistent with the opening direction of the opening 14.

Referring to FIG. 2, in the present embodiment, the double-channel paper feeding mechanism further includes a conveying mechanism 4. The conveying mechanism 4 includes a first roller wheel component 41 and a second roller wheel component 42. The first roller wheel component 41 is arranged in the first input channel 8, and includes a first roller wheel 411 arranged on the fixed frame 1 and a second roller wheel 412 arranged on the movable frame 2. The second roller wheel component 42 is arranged in the second input channel 9, and includes a third roller wheel 421 arranged on the fixed frame 1 and a fourth roller wheel 422 arranged on the movable frame 2. When the movable frame 2 is mounted on the fixed frame 1, the first roller wheel 411 is tangent with the second roller wheel 412, and the third roller wheel 421 is tangent with the fourth roller wheel 422.

As shown in FIG. 3, when the movable frame 2 is required to be mounted on the fixed frame 1, the movable frame 2 aims to the opening 14 of the fixed frame 1 at first, and then the movable frame 2 is moved to enable the first inserting portion 312 to be inserting in the first inserting groove 311. Next, the clamping portion 322 is pulled to slide the clamping portion 322 along the limiting hole 323, thereby clamping the clamping portion 322 into the clamping groove 321. At this time, under the action of an elastic force of the first elastic element 324, it is unable to separate the clamping portion 322 from the clamping groove 321. Since the opening direction of the clamping groove 321 and the opening direction of the opening 14 form the included angle, the movement of the movable frame 2 along the direction of the opening 14 is limited, thereby keeping the movable frame 2 and the fixed frame 1 in fixed connection.

When the movable frame 2 is required to be removed from the fixed frame 1, for example, when the medium is jammed in the first input channel 8 or the second input channel 9, the clamping portion 322 is pulled to counteract the resistance of the first elastic element 324 and slide along the limiting hole 323, so that the clamping portion 322 is separated from the clamping groove 321. Then, the movable frame 2 is pulled towards a direction away from the opening 14, so that the first inserting portion 312 is separated from the first inserting groove 311 to separate the movable frame 2 from the fixed frame 1, thereby enabling the first input channel 8 and the second input channel 9 to be completely opened.

The double-channel paper feeding mechanism provided by the present disclosure has the advantages of simple structure and convenient maintenance.

Figure 5:
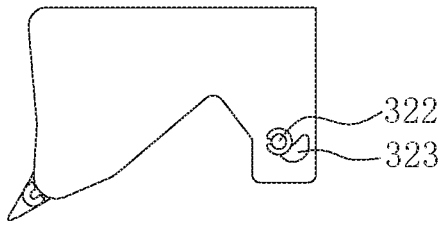
FIG. 5 is a structural schematic view of a movable frame of a double-channel paper feeding mechanism provided by a second embodiment.

FIG. 5 is a structural schematic view of a movable frame of a double-channel paper feeding mechanism provided by a second embodiment. As shown in FIG. 5, on the basis of above embodiments, the limiting hole 323 of the double-channel paper feeding mechanism provided by the present embodiment is a U-shaped hole.

The U-shaped hole 323 includes a first end and a second end. Under the action of the first elastic element 324, the clamping portion 322 may be stably maintained at the first end or the second end. When the movable frame 2 is mounted on the fixed frame 1, the clamping portion 322 and the clamping groove 321 are in a clamped state if the clamping portion 322 is located in the first end of the U-shaped hole, and the clamping portion 322 and the clamping groove 321 are in a separate state if the clamping portion 322 is located in the second end of the U-shaped hole.

The limiting hole of the double-channel paper feeding mechanism provided by the present embodiment is the U-shaped hole. No matter the movable frame is mounted on the fixed frame or removed from the fixed frame, the clamping portion may stably stay at the first end or the second end without pulling the clamping portion all the time, thereby improving the usability of the double-channel paper feeding mechanism.

Figure 6:
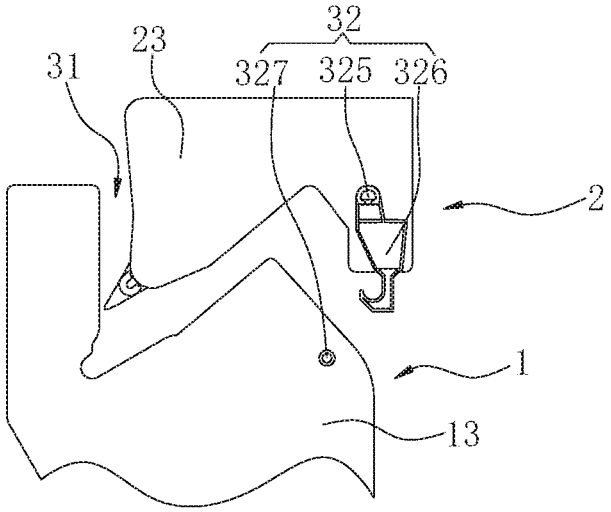
FIG. 6 is a structural schematic view of a double-channel paper feeding mechanism provided by a third embodiment.

FIG. 6 is a structural schematic view of a double-channel paper feeding mechanism provided by a third embodiment. As shown in FIG. 6, on the basis of above embodiments, the locking component 32 of the double-channel paper feeding mechanism provided by the present embodiment adopts different forms.

The locking component 32 includes a rotation shaft 325, a locking hook 326 and a pin shaft 327. The rotation shaft 325 is pivoted with one of the second side plate 23 of the movable frame 2 and the first side plate 13 of the fixed frame 1. The locking hook 326 is fixedly connected to the rotation shaft 325. The pin shaft 327 is fixedly arranged on the other one of the first side plate 13 of the fixed frame 1 and the second side plate 23 of the movable frame 2. In the present embodiment, the rotation shaft 325 is pivoted with the second side plate 23 of the movable frame 2. The pin shaft 327 is fixedly arranged on the first side plate 13 of the fixed frame 1. The locking hook 326 of the locking component 32 may be in clamping fit with or separated from the pin shaft 327. When the movable frame 2 is mounted on the fixed frame 1, the locking hook 326 is in clamping fit with the pin shaft 327. In one or more embodiments, two locking hooks 326 are arranged, and two pin shafts 327 are arranged. The rotation shaft 325 extends along the width direction of the channel. The rotation shaft 325 is pivoted to the second side plates 23 of the fixed frame and the movable frame at the same time. The two locking hooks 326 are fixedly connected to both ends of the rotation shaft 325 respectively, and the two pin shafts 327 are respectively arranged on the two first side plates 13. In one or more embodiments, the locking component 32 further includes an elastic element and a wrench. When the movable frame 2 is mounted on the fixed frame 1, the elastic element enables the locking hooks 326 to be in clamping fit with the pin shafts 327. The wrench is configured to rotate the rotation shaft 325 to enable the locking hooks 326 to be in clamping with or separated from the pin shafts 327.

When the movable frame 2 is required to be mounted on the fixed frame 1, the movable frame 2 aims to the opening 14 of the fixed frame 1 at first, and then the movable frame 2 is moved to enable the first inserting portion 312 to be in inserting fit with the first inserting groove 311. Then, the rotation shaft 325 is rotated towards the pin shafts 327 to enable the locking hooks 326 to be in clamping fit with the pin shafts 327, thereby keeping the movable frame 2 and the fixed frame 1 in fixed connection. When the movable frame 2 is required to be removed from the fixed frame 1, the rotation shaft 325 is rotated towards a direction away from the pin shafts 327 at first to enable the locking hooks 326 to be separated from the pin shafts 327, thereby separating the movable frame 2 from the fixed frame 1.

The first end of the double-channel paper feeding mechanism provided by the present embodiment is connected in a manner of inserting the inserting groove and the inserting portion, and the second end is connected in a manner of clamping the locking hooks and the pin shafts. During maintenance, it only needs to rotate the rotation shaft to separate the locking hooks from the pin shafts, and then the movable frame is pulled to open the channels, facilitating the maintenance.

Figure 7:
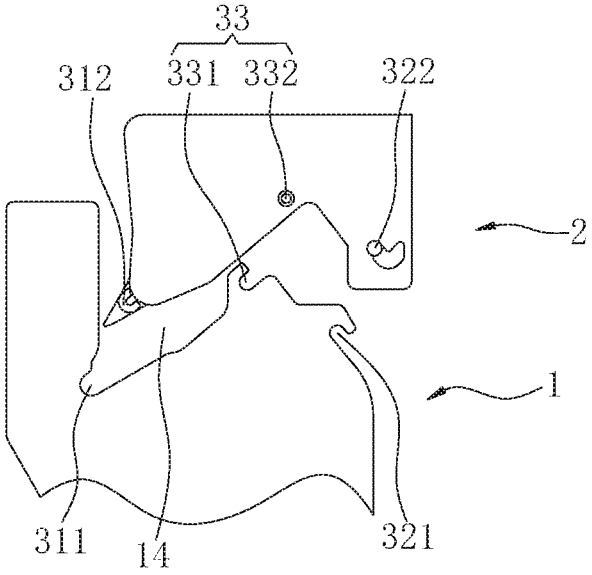
FIG. 7 is a structural schematic view of a double-channel paper feeding mechanism provided by a fourth embodiment.

FIG. 7 is a structural schematic view of a double-channel paper feeding mechanism provided by a fourth embodiment. As shown in FIG. 7, on the basis of above embodiments, the double-channel paper feeding mechanism provided by the present embodiment is further provided with a second locating component 33.

The second locating component 33 includes a second inserting groove 331 and a second inserting portion 332 which are selectively in inserting fit with each other. When the movable frame 2 is mounted on the fixed frame 1, the second inserting portion 332 is inserted into the second inserting groove 331. The second inserting groove 331 is formed in one of the fixed frame 1 and the movable frame 2. The second inserting portion 332 is arranged on the other one of the fixed frame 1 and the movable frame 2. In the present embodiment, the second inserting groove 331 is formed in the fixed frame 1, and the second inserting portion 332 is arranged on the movable frame 2. In one or more embodiments, the second inserting groove 331 is arranged between the first inserting groove 311 and the clamping groove 321, and the opening direction of the second inserting groove 331 is consistent with the opening direction of the first inserting groove 311.

When the movable frame 2 is required to be mounted on the fixed frame 1, the movable frame 2 is moved towards the opening 14 at first to enable the first inserting portion 312 and the second inserting portion 332 to be respectively in inserting fit with the first inserting groove 311 and the second inserting groove 331, and then the clamping portion 322 is inserted into the clamping groove 321. When the movable frame 2 is required to be removed from the fixed frame 1, the clamping portion 322 is pulled at first to be separated from the clamping groove 321, and then the movable frame 2 is pulled towards a direction away from the opening 14 to separate the first inserting portion 312 and the second inserting portion 332 from the first inserting groove 311 and the second inserting groove 331 respectively.

The second locating component arranged on the double-channel paper feeding mechanism provided by the present embodiment further improves the reliability of connection between the movable frame and the fixed frame, thereby improving the working stability of the double-channel paper feeding mechanism.

Figure 8:
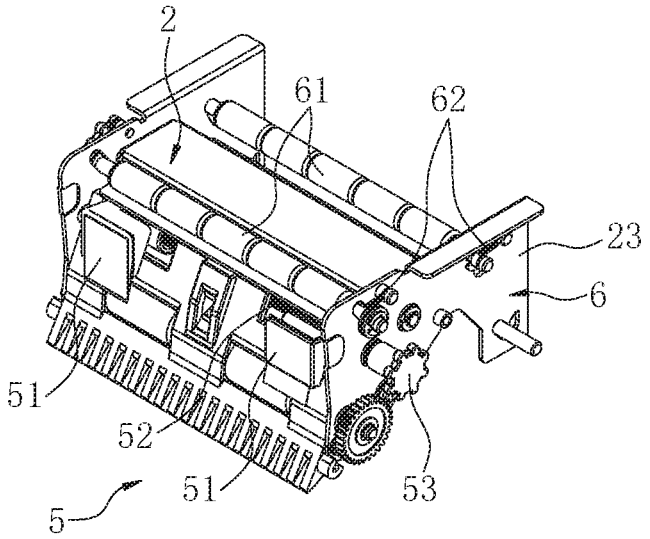
FIG. 8 is a structural schematic view of a movable frame of a double-channel paper feeding mechanism provided by a fifth embodiment.

FIG. 8 is a structural schematic view of a movable frame of a double-channel paper feeding mechanism provided by a fifth embodiment. As shown in FIG. 8, on the basis of above embodiments, the double-channel paper feeding mechanism provided by the present embodiment further includes a paper limiting mechanism 5.

The paper limiting mechanism 5 is arranged in at least one of the first input channel and the second input channel, and is configured to limit a position of medium in the input channel. The paper limiting mechanism 5 includes at least one paper limiting plate 51. The paper limiting plate 51 may move along a width direction of the input channel. In the present embodiment, the paper limiting mechanism 5 is arranged in the second input channel, and the paper limiting mechanism 5 includes two paper limiting plates 51 which are arranged along the width direction of the second input channel and separating from each other.

In one or more embodiments, the paper limiting mechanism 5 further includes a threaded rod 52. Both ends of the threaded rod 52 are supported by the two second side plates 23 of the movable frame 2. The paper limiting plates 51 are provided with internal threads. One paper limiting plate 51 is sleeved to the threaded rod 52. The internal thread of the paper limiting plate 51 engages with the thread of the threaded rod 52. The threaded rod 52 is rotated to adjust the position of the paper limiting plate 51 along the width direction of the channel. In one or more embodiments, the threaded rod 52 extends out of the movable frame 2. The threaded rod 52 is fixedly connected with a rotating wheel 53. The rotating wheel 53 is rotated to rotate the threaded rod 52, thereby driving the paper limiting plate 51 to move along the width direction of the channel.

In one or more embodiments, a buffer mechanism 6 is further arranged at an inlet of at least one of the first input channel and the second input channel. The buffer mechanism 6 includes a buffer roller 61 and a second elastic element 62. In the embodiment, the buffer mechanism 6 is arranged at the inlet of the second input channel. Both ends of the buffer roller 61 are inserted into long circular holes in the second side plates 23 of the movable frame 2. The first end of the second elastic element 62 is connected with the buffer roller 61, and the second end of the second elastic element 62 is connected to the movable frame 2. Under the action of the second elastic element 62, the buffer roller 61 always has a motion tendency of deviating from the second input channel.

When the double-channel paper feeding mechanism works, the medium bypasses the buffer roller 61 and enters the second input channel 9. Under the action of the second elastic element 62, the buffer roller 61 gets away from the inlet of the second input channel, and a paper feeding path of the medium has a relatively long distance at this time. At the moment of paper feeding, when a subsequent medium may not move forwards immediately by inertia, then a pull force on the medium increases to counteract the action of the second elastic element 62 and force the buffer roller 61 to move towards the inlet of the channel, so that the distance of the paper feeding path is shortened and part of the media is released, thereby avoiding printing compression.

The paper limiting mechanism arranged in the double-channel paper feeding mechanism provided by the present embodiment enables to adjust the position of the medium along the width direction of the channel, so that the adaptability of the double-channel paper feeding mechanism for medium with different widths is improved. The buffer mechanism further avoids the printing compression, so that the applicability of the double-channel paper feeding mechanism is improved.

FIG. 9 is a sectional view of a sheet medium processing device using the double-channel paper feeding mechanism provided by the present embodiment. In the present embodiment, the sheet medium processing device is a bill issuing apparatus. As shown in FIG. 9, the sheet medium processing device includes a paper supply mechanism 100, a double-channel paper feeding mechanism 200, medium conveying channel 300, a paper cutting mechanism 400 and a paper outlet 500. In the present embodiment, the paper supply mechanism 100 includes a bracket 110 and two rotation shafts 120. The bracket 110 is configured to fix and support the rotation shafts 120. Two rolls of media are respectively hung on the two rotation shafts 120. In other embodiments of the present disclosure, the paper supply mechanism 100 may be a paper bin. The medium enters the medium conveying channel 300 through one of the input channels of the double-channel paper feeding mechanism 200, and moves to the paper cutting mechanism 400 along the medium conveying channel 300 for cutting treatment. Then, the medium is discharged through the paper outlet 500. The double-channel paper feeding mechanism 200 adopts any one of the above-mentioned double-channel paper feeding mechanisms. The structural form and the working principle of the double-channel paper feeding mechanism have been provided in the descriptions of above embodiments, so that no more details will be described herein. In one or more embodiments, the sheet medium processing device further includes a printing mechanism 600. The printing mechanism 600 includes a printing head 610 and a roller wheel 620. The printing head 610 is configured to print set words and images on the medium. The roller wheel 620 is connected with a motor through a transmission mechanism, and is configured to drive the medium to move along the medium conveying channel 300. In one or more embodiments, the sheet medium processing device is provided with two printing mechanisms 600. The two printing mechanisms 600 are arranged on both sides of a thickness direction of the medium on the medium conveying channel 300. Both surfaces of the medium may be printed at one time when the medium passes through the medium conveying channel 300, so that the working efficiency of the sheet medium processing device is increased.

The sheet medium processing device provided by the present embodiment has the advantage of convenient maintenance due to the use of the double-channel paper feeding mechanism provided by the present disclosure.

In the description of the present disclosure, terms "first", "second", "third" and "fourth" are only used for distinguishing descriptions, and do not have any special meanings.

Above specific implementation modes are only optional embodiments and applied technical principles of the present disclosure.

INDUSTRIAL PRACTICABILITY

The second portions of the two channel plates on the fixed frame of the double-channel paper feeding mechanism provided by the present disclosure form the opening for inserting the movable frame. When the movable frame is inserted into the opening, the movable frame is opposite to the channel plates on the fixed frame, thereby forming the two input channels. When the paper jamming occurs in the input channels, it only needs to relieve the connection of the connection mechanisms to draw the movable frame out of the opening to enable the two input channels to be opened completely, thereby conveniently eliminating the jammed paper. Therefore, the double-channel paper feeding mechanism provided by the present disclosure has the advantages of simple structure and convenient maintenance.

What is claimed is:

1. A double-channel paper feeding mechanism, comprising a fixed frame, a movable frame and a connection mechanism, wherein the fixed frame is provided with a first channel plate and a second channel plate, a first portion of the first channel plate and a first portion of the second channel plate are arranged oppositely and form a conveying channel; an opening for inserting the movable frame is formed between a second portion of the first channel plate and a second portion of the second channel plate; the movable frame is detachably connected with the fixed frame through the connection mechanism; the movable frame is provided with a third channel plate and a fourth channel plate; the movable frame is configured to, in a condition that the movable frame is mounted on the fixed frame, enable the third channel plate to be opposite to the second portion of the first channel plate so as to form a first input channel between the third channel plate and the second portion of the first channel plate, and enable the fourth channel plate to be opposite to the second portion of the second channel plate so as to form a second input channel between the fourth channel plate and the second portion of the second channel plate, wherein the first input channel is in connection with the conveying channel and the second input channel is also in connection with the conveying channel.

2. The double-channel paper feeding mechanism according to claim 1, wherein the connection mechanism comprises a first locating component and a locking component; the movable frame is inserted with the fixed frame through the first locating component; and the movable frame is clamped and locked with the fixed frame through the locking component to fix a position of the movable frame relative to the fixed frame.

3. The double-channel paper feeding mechanism according to claim 2, wherein the first locating component comprises a first inserting groove and a first inserting portion; the first inserting groove is formed in one of the fixed frame and the movable frame; the first inserting portion is arranged on the other one of the fixed frame and the movable frame; the first inserting groove has an opening; the first inserting groove is capable of being in inserting fit with the first inserting portion.

4. The double-channel paper feeding mechanism according to claim 2, wherein the locking component comprises a clamping groove, a clamping portion, a limiting hole and a first elastic element; the clamping groove is formed in one of the fixed frame and the movable frame; the clamping portion, the limiting hole and the first elastic element are arranged on the other one of the fixed frame and the movable frame; the clamping groove has an opening; the clamping portion is inserted with the limiting hole and is capable of being clamped with or separated from the clamping groove; a first end of the first elastic element is connected with the clamping portion, and a second end of the first elastic element is fixed to the frame in which the first elastic element is arranged; the first elastic element always has a tendency of pulling the clamping portion towards a direction opposite to an opening direction of the clamping groove.

5. The double-channel paper feeding mechanism according to claim 4, wherein the limiting hole is a U-shaped hole; the U-shaped hole comprises a first end and a second end; under the action of the first elastic element, the clamping portion is capable of being stably maintained at the first end or the second end of the U-shaped hole; in a case where the movable frame is mounted on the fixed frame, the clamping portion and the clamping groove are in a clamped state when the clamping portion is located in the first end, and the clamping portion and the clamping groove are in a separate state when the clamping portion is located in the second end.

6. The double-channel paper feeding mechanism according to claim 4, wherein the first locating component comprises a first inserting groove and a first inserting portion; the first inserting groove is formed in one of the fixed frame and the movable frame; the first inserting portion is arranged on the other one of the fixed frame and the movable frame; the first inserting groove has an opening; the first inserting groove is capable of being in inserting fit with the first inserting portion; the first inserting groove and the clamping groove are arranged at an interval, an opening direction of the first inserting groove and an opening direction of the clamping groove form an included angle.

7. The double-channel paper feeding mechanism according to claim 2, wherein the locking component comprises a rotation shaft, a locking hook and a pin shaft; the rotation shaft is pivoted with one of the fixed frame and the movable frame; the locking hook is fixedly connected to the rotation shaft; the pin shaft is fixedly arranged on the other one of the fixed frame and the movable frame; and the locking hook is selectively clamped with the pin shaft.

8. The double-channel paper feeding mechanism according to claim 1, further comprising a second locating component; wherein the second locating component comprises a second inserting groove and a second inserting portion; the second inserting groove and the second inserting portion are selectively in inserting fit with each other; the second inserting groove is formed in one of the fixed frame and the movable frame, and the second inserting portion is arranged on the other one of the fixed frame and the movable frame; when the movable frame is mounted on the fixed frame, the second inserting portion is inserted into the second inserting groove.

9. The double-channel paper feeding mechanism according to claim 1, further comprising a paper limiting mechanism, wherein the paper limiting mechanism is arranged in at least one of the first input channel and the second input channel and is configured to limit a position of medium in the at least one of the first input channel and the second input channel;

wherein the paper limiting mechanism comprises at least one paper limiting plate; and the paper limiting plate is capable of moving along the width direction of the input channel.

10. A sheet medium processing device, comprising a double-channel paper feeding mechanism, wherein the double-channel paper feeding mechanism comprises a fixed frame, a movable frame and a connection mechanism, wherein the fixed frame is provided with a first channel plate and a second channel plate, a first portion of the first channel plate and a first portion of the second channel plate are arranged oppositely and form a conveying channel; an opening for inserting the movable frame is formed between a second portion of the first channel plate and a second portion of the second channel plate; the movable frame is detachably connected with the fixed frame through the connection mechanism; the movable frame is provided with a third channel plate and a fourth channel plate; the movable frame is configured to, in a condition that the movable frame is mounted on the fixed frame, enable the third channel plate to be opposite to the second portion of the first channel plate so as to form a first input channel between the third channel plate and the second portion of the first channel plate, and enable the fourth channel plate to be opposite to the second portion of the second channel plate so as to form a second input channel between the fourth channel plate and the second portion of the second channel plate, wherein the first input channel is in connection with the conveying channel and the second input channel is also in connection with the conveying channel.

11. The sheet medium processing device according to claim 10, wherein the connection mechanism comprises a first locating component and a locking component; the movable frame is inserted with the fixed frame through the first locating component; and the movable frame is clamped and locked with the fixed frame through the locking component to fix a position of the movable frame relative to the fixed frame.

12. The sheet medium processing device according to claim 11, wherein the first locating component comprises a first inserting groove and a first inserting portion; the first inserting groove is formed in one of the fixed frame and the movable frame; the first inserting portion is arranged on the other one of the fixed frame and the movable frame; the first inserting groove has an opening; the first inserting groove is capable of being in inserting fit with the first inserting portion.

13. The sheet medium processing device according to claim 11, wherein the locking component comprises a clamping groove, a clamping portion, a limiting hole and a first elastic element; the clamping groove is formed in one of the fixed frame and the movable frame; the clamping portion, the limiting hole and the first elastic element are arranged on the other one of the fixed frame and the movable frame; the clamping groove has an opening; the clamping portion is inserted with the limiting hole and is capable of being clamped with or separated from the clamping groove; a first end of the first elastic element is connected with the clamping portion, and a second end of the first elastic element is fixed to the frame in which the first elastic element is arranged; the first elastic element always has a tendency of pulling the clamping portion towards a direction opposite to an opening direction of the clamping groove.

14. The sheet medium processing device according to claim 13, wherein the limiting hole is a U-shaped hole; the U-shaped hole comprises a first end and a second end; under the action of the first elastic element, the clamping portion is capable of being stably maintained at the first end or the second end of the U-shaped hole; in a case where the movable frame is mounted on the fixed frame, the clamping portion and the clamping groove are in a clamped state when the clamping portion is located in the first end, and the clamping portion and the clamping groove are in a separate state when the clamping portion is located in the second end.

15. The sheet medium processing device according to claim 13, wherein the first locating component comprises a first inserting groove and a first inserting portion; the first inserting groove is formed in one of the fixed frame and the movable frame; the first inserting portion is arranged on the other one of the fixed frame and the movable frame; the first inserting groove has an opening; the first inserting groove is capable of being in inserting fit with the first inserting portion; the first inserting groove and the clamping groove are arranged at an interval, an opening direction of the first inserting groove and an opening direction of the clamping groove form an included angle.

16. The sheet medium processing device according to claim 11, wherein the locking component comprises a rotation shaft, a locking hook and a pin shaft; the rotation shaft is pivoted with one of the fixed frame and the movable frame; the locking hook is fixedly connected to the rotation shaft; the pin shaft is fixedly arranged on the other one of the fixed frame and the movable frame; and the locking hook is selectively clamped with the pin shaft.

17. The sheet medium processing device according to claim 10, further comprising a second locating component; wherein the second locating component comprises a second inserting groove and a second inserting portion; the second inserting groove and the second inserting portion are selectively in inserting fit with each other; the second inserting groove is formed in one of the fixed frame and the movable frame, and the second inserting portion is arranged on the other one of the fixed frame and the movable frame; when the movable frame is mounted on the fixed frame, the second inserting portion is inserted into the second inserting groove.

18. The sheet medium processing device according to claim 10, further comprising a paper limiting mechanism, wherein the paper limiting mechanism is arranged in at least one of the first input channel and the second input channel and is configured to limit a position of medium in the at least one of the first input channel and the second input channel;

wherein the paper limiting mechanism comprises at least one paper limiting plate; and the paper limiting plate is capable of moving along the width direction of the input channel.

* * * * *